United States Patent [19]

Hildebrand et al.

[11] Patent Number: 4,770,745

[45] Date of Patent: Sep. 13, 1988

[54] FRONT WALL AND SUPPORT ARRANGEMENT AT THE HEADBOX OF A PAPERMAKING MACHINE

[75] Inventors: Otto Hildebrand, Ravensburg-Taldorf, Fed. Rep. of Germany; Edwin X. Graf, Middletown, Ohio

[73] Assignee: Sulzer-Escher Wyss GmbH, Ravensburg, Fed. Rep. of Germany

[21] Appl. No.: 929,481

[22] Filed: Nov. 12, 1986

[30] Foreign Application Priority Data

Nov. 19, 1985 [CH] Switzerland ..... 04922/85

[51] Int. Cl.[4] ..... D21F 1/02

[52] U.S. Cl. ..... 162/336; 162/347

[58] Field of Search ..... 162/336, 337, 338, 339, 162/340, 344, 347

[56] References Cited

U.S. PATENT DOCUMENTS 3,769,154 10/1973 Wolf ..... 162/336
4,008,123 2/1977 Kirjavainen ..... 162/336

FOREIGN PATENT DOCUMENTS 2117770 10/1972 Fed. Rep. of Germany .
2072310 9/1971 France .
2262716 9/1975 France .
1112134 5/1968 United Kingdom .
1145299 3/1969 United Kingdom .
2139660 11/1984 United Kingdom .

OTHER PUBLICATIONS

Article from German Language publication "Das Papier", 35 Jahrgang, vol. 10, 1981 of H. Kiessling, pages 445 to 452.

*Primary Examiner*—David L. Lacey
*Assistant Examiner*—K. M. Hastings
*Attorney, Agent, or Firm*—Werner W. Kleeman

[57] ABSTRACT

The front wall and support arrangement is shaped as a stiff support structure extending across the entire machine width above a slice chamber. The support structure is deformed due to its inherent weight and because of the pressures and temperatures prevailing in the slice chamber. To counteract these deformation effects the support structure is supported by a support carrier of about the same length as the support structure. To attain a substantially lower structural height, the support carrier is arranged relative to the support structure such that an intermediate space prevails between the lower wall of the support structure and the support carrier. This intermediate space accommodates force-generating support elements. Each of the force-generating support elements is provided for only a portion of the surface or area to be supported in the intermediate space. In a preferred embodiment the support structure is a box-like girder equipped with an upright positioned I-profile constituting the support carrier and arranged within the interior space of the box-like girder. Advantageously, the support elements are elastic tubes closed at both ends and extending substantially parallel to the longitudinal axis of the front wall, and the individual elastic tubes are each connected to at least one pressure source.

19 Claims, 2 Drawing Sheets

FRONT WALL AND SUPPORT ARRANGEMENT AT THE HEADBOX OF A PAPERMAKING MACHINE

BACKGROUND OF THE INVENTION

The present invention relates to a new and improved front wall and support arrangement at the headbox of a papermaking machine.

Generally speaking, the front wall and support arrangement of the present invention comprises a relatively stiff support structure supported by a support carrier of about the same length as the support structure. This support structure extends over the entire machine width transverse to the direction of travel of the paper web and is positioned above the slice chamber of the headbox.

The front wall at the headbox of a papermaking machine is an important element as concerns the shaping or configuration of a proper lip geometry, that is to say, the distance between a lower lip and an upper lip of the headbox. This exact configuration of the lip geometry is responsible for the quality features or characteristics of the produced paper web. This precision is especially important with wide and high-speed operating papermaking machines. It is known that deviations in the lip geometry can lead to up to 10 to 15 times greater deviations of the weight per unit area or surface weight profile of the paper web.

At the upper lip a diaphragm or baffle plate defines the distance between the upper lip and the lower lip and thus the size of the slice opening or outlet. This diaphragm or baffle plate and the adjusting devices for the exact adjustment thereof are carried by the front wall.

The front wall itself, nowadays built as an upright box support or girder, constitutes the upper boundary of the nozzle or slice chamber of the headbox. Therefore, this box support or girder is subjected to the pressure of the warm stock slurry or stock suspension which exits through the slice opening or outlet. The pressure and the temperature in the slice chamber as well as the weight of the front wall itself lead to deflections which may be either concave or convex in respect to the slice chamber. It is therefore endeavored to counteract the deforming effects or influences exerted upon the box support or girder in the reverse direction in order to compensate for the deformation and to bring it towards zero level, i.e. to eliminate the same as much as possible. This is done so as to achieve as uniform as possible or as straight as possible cross-section or profile of the slice opening or outlet or the height of the slice chamber, respectively, and as a result as good as possible uniformity, both locally and as a function of time, of the flow of the stock through the elongated slice opening or outlet.

A known front wall construction utilizes an additional support carrier which extends along and above the front wall. To counter the deformation forces there is provided a chamber between the support carrier and the front wall. This chamber contains a pressure medium or heating medium.

This state-of-the-art front wall has proven to be quite satisfactory. However, the total or overall constructional height is very large, about twice the height of the front wall itself. Sealing problems pose further difficulties during sealing of the pressure chamber.

SUMMARY OF THE INVENTION

Therefore, with the foregoing in mind, it is a primary object of the present invention to provide a new and improved construction of a front wall and support arrangement at the headbox of a papermaking machine which does not exhibit the aforementioned drawbacks and shortcomings of the prior art constructions.

Another and more specific object of the present invention aims at providing a new and improved construction of a front wall and support arrangement of the previously mentioned type, which occupies less space, thereby retaining the functional quality or characteristics of the known construction but while eliminating the dreaded sealing difficulties and the consequent disturbances or breakdowns.

Yet a further significant object of the present invention aims at providing a new and improved construction of a front wall and support arrangement at the headbox of a papermaking machine and which is relatively simple in construction and design, extremely economical to manufacture, highly reliable in operation, not readily subject to breakdown or malfunction and requires a minimum of maintenance and servicing.

Now in order to implement these and still further objects of the present invention, which will become more readily apparent as the description proceeds, the front wall and support arrangement of the present invention is manifested by the features that the support structure and the support carrier are arranged in relation to one another such that between the lower wall of the support structure and the confronting surface of the support carrier there is left free or formed an intermediate space or region for accommodating therein force-generating support elements. Each of these force-generating support elements is provided for or operatively associated with only a portion of the surface of the intermediate space which is to be supported.

A preferred embodiment of the invention contemplates configuring the front wall and support arrangement in the form of a closed substantially box or box-like girder comprising an upright positioned quadrangular, for instance, rectangular profile or cross-section. Within this box-like girder forming the front wall there is positioned the support carrier. In the internal space of the box-like girder a respective intermediate space is formed or provided between the upper and lower walls of the box-like girder and the confronting surfaces of the support carrier. These intermediate spaces serve to accommodate between the box-like girder and the support carrier the force-generating support elements which are capable of being impinged or filled with a pressure or pressurized medium.

The support carrier is preferably constituted by an I-beam which is arranged in an upright position within the box or box-like girder.

Another preferred embodiment is realized in that the force-generating support elements are constituted by elastic tubes which are closed at both ends thereof. These elastic tubes extend substantially parallel to the longitudinal or lengthwise axis of the box girder, and each of these support elements is connected to at least one pressure source.

With the above design the objects of the present invention can be fully realized. The front wall and support arrangement is now reduced to half the size of the known construction. The front wall and support arrangement is now only as high as the box girder.

Through the use of the very easily and reliably sealable support elements, sealing difficulties and the breakdowns arising therefrom are therefore eliminated.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
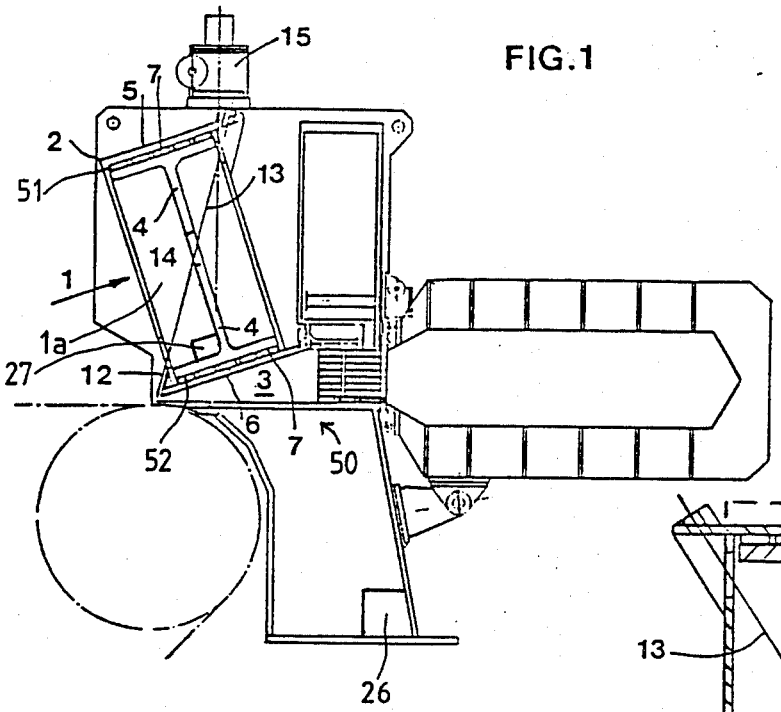
FIG. 1 schematically shows in side elevation and cross-section a headbox of a papermaking machine according to the invention.
Figure 3:
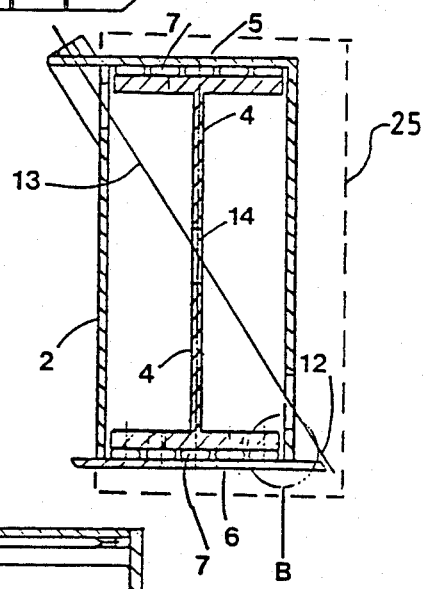
FIG. 3 shows a sectional view through the front wall and support arrangement taken along the line A—A in FIG. 2.

Describing now the drawings, it is to be understood that to simplify the showing thereof only enough of the structure of the front wall has been illustrated therein as is needed to enable one skilled in the art to readily understand the underlying principles and concepts of the present invention. Turning now specifically to FIGS. 1 to 4 of the drawings, the apparatus illustrated therein by way of example and not limitation will be seen to comprise a support structure here depicted in the form of an enclosed box or box-like support or girder 2 having a quadrangular, such as a rectangular or square profile or cross-section. This box girder or support 2 is uprightly positioned and extends transversely with respect to the direction of travel of the paper web and also extends over the total or entire width of the papermaking machine, i.e. in the direction of the cross-machine width. The lower wall 6 of this box girder or support 2 confronts from the top a nozzle or slice chamber 3 of the headbox, generally indicated by reference numeral 50. The enclosed box girder 2, forming the front wall or front wall and support arrangement 1 is supported by means of a support carrier here shown as a beam 4 of approximately the same length as the box or box-like girder.

This beam or carrier 4 is positioned within the enclosed box girder 2, and specifically within the interior or internal space 1*a* thereof. The beam 4 is arranged within this internal space 1*a* such that within the enclosed box girder 2 there is formed between its upper wall 5 and its lower wall 6 and the associated confronting or adjacent surfaces of the beam 4 a respective intermediate space 51 and 52. These intermediate spaces 51 and 52 between the enclosed box 2 girder and the beam 4 are each sufficiently large to accommodate therein force-generating or force-exerting support elements 7 which are acted upon or impinged by a suitable pressure or pressurized medium. As is clearly illustrated in FIG. 3, each of these support or supporting elements 7 only serves to support a portion of the total area or surface of these intermediate spaces 51 and 52 which are to be supported. The individual force-generating support elements 7 are depicted in a juxtaposed position in the relevant space 51 and 52 between the beam 4 and the upper and lower walls 5 and 6, respectively.

The beam or carrier 4 is constituted, for instance, by an upright arranged I-beam positioned within the internal space 1*a* of the enclosed box girder 2 which is also arranged in an upright position.

The force-generating support elements 7 are constituted, for instance, by elastic tubes or hoses having both of their ends closed. These hose-like support elements or tubes 7 are individually connected to at least one pressure medium source, as for instance generally indicated by reference numeral 53 in FIG. 4. Also, such hose-like support elements or tubes 7 run or extend substantially parallel to the longitudinal axis of the front wall 1. These tubes or hoses, constituting the support elements 7, are positioned or located between the relevant wall 5 and 6 of the enclosed box girder 2 to be supported and their associated opposite surface of the beam 4 which confronts these walls 5 and 6 in a spaced relationship. These tubes or hoses are closely juxtaposedly arranged and snugly bear against the surfaces or walls 5 and 6 to be supported.

Figure 4:
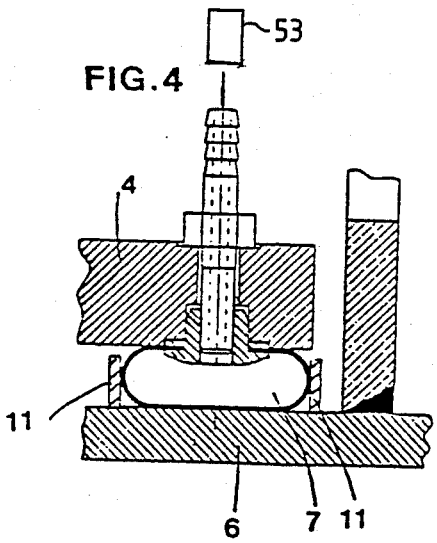
FIG. 4 shows an enlarged detail at the region designated by the reference character B in FIG. 3.

As previously mentioned the execution of the connection of an individual support element 7 to at least one pressure medium source or supply 53 is particularly clearly shown in FIG. 4.

The elastic tubes or hoses, constituting the support elements 7, can be closed tube segments or sections extending substantially parallel to the longitudinal axis of the enclosed box girder 2 and individually connected to a pressure source such that they can be separately or individually pressurized, so that a different pressure may be set or may prevail in the individual tubes or hoses. In this manner several zones may be created within which there prevail different pressures. It is therefore possible, for instance, to group these longitudinal elastic tube segments to form length zones extending across the entire length of the enclosed box girder 2, whereby each length zone contains a plurality of juxtaposed elastic tube segments, each elastic tube segment only covering part of the total length of the enclosed box girder 2. On the other hand, other zones may be arranged so as to extend across the width of the enclosed box girder 2, each zone containing a plurality of elastic tubes or hoses, whereby each elastic tube extends over the entire width of the enclosed box girder 2. Thus, conceptually the hose-like support elements 7 shown in FIG. 1 can be visualized as not only extending in the lengthwise or longitudinal direction of the box-like or box girder 2 but also in the transverse direction or across the width thereof.

Figure 2:
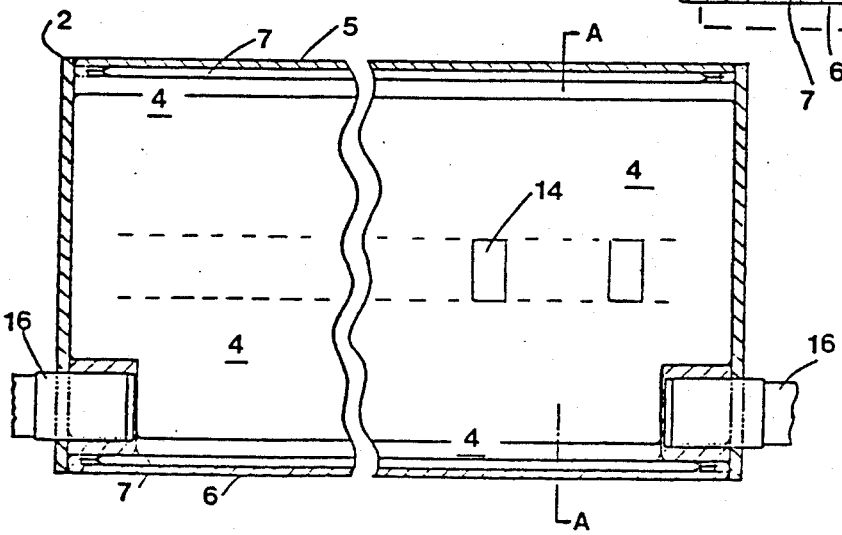
FIG. 2 shows a longitudinal cross-section of the headbox as seen looking from the direction of the arrow 1 in FIG. 1.

An advantageous embodiment of a tube, constituting the support element 7 and closed at both its ends, is depicted in FIG. 2. The support element 7 is shown to lie and to be snugly pressed between and in contacting relationship with the lower wall 6 of the enclosed box girder 2 and the confronting surface of the beam 4 lying adjacent this lower wall 6. When compensating the deflection of the beam 4, the distance between the lower wall 6 of the enclosed box girder 2 and the beam 4 changes. In order to prevent undesired deformation of the support element 7 in the transverse sense, the support element 7 can lie between walls or strips or ledges 11 extending substantially parallel to the support element 7 and across the related intermediate space. However with these measures it can not be prevented that the tube profile as shown in FIG. 4 changes in such a manner that the support element 7 only contacts a smaller surface area or region of the lower wall 6 when this lower wall 6 moves away from the beam 4 during compensation of the deflection. Because of the deformation or change of shape into a rounder shape the support element 7 consequently contacts a smaller area not only with regard to the beam 4 but also with regard to the lower wall 6 of the enclosed box girder 2.

Figure 6:
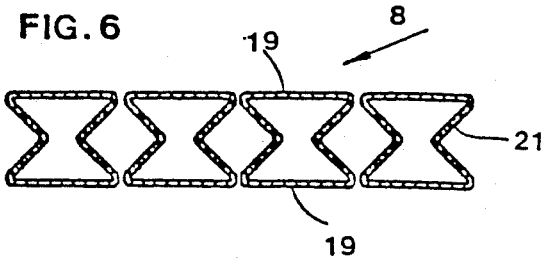
FIG. 6 shows one embodiment of support elements constructed according to the invention and depicted in cross-section.

A better embodiment or improved configuration of the support element 7 is depicted in FIG. 6. Here the tubes or hoses have a bellows-like cross-sectional shape or profile 8 featuring oppositely situated bent or folded sides 21 and oppositely situated flat sides 19. These flat sides 19 are designed to abut or contact the neighboring surface of the beam 4 and the associated wall 5 and 6, respectively, of the enclosed box girder 2. In the foregoing case each support element 7 always bears or contacts with the same surface area against the related wall of the relevant intermediate space and independent of the change of distance between the beam 4 and the relevant wall 5 or 6, for example the lower wall 6 of the enclosed box girder 2.

As can be deduced from the drawings, the force-generating support elements 7 may be located between the beam 4 and the lower wall 6 of the enclosed box girder 2 and equally as well between the beam 4 and the upper wall 5 of the enclosed box girder 2. The upper support elements, that is to say, the support elements 7 which are positioned along the upper wall 5 of the enclosed box girder 2, may serve to compensate for a deformation of the enclosed box girder 2 caused by the effects of the temperature and the inherent weight of the front wall 1. The lower support elements 7, that is to say, the support elements which are positioned along the lower wall 6 of the enclosed box girder 2 mainly serve to compensate for a deformation of the enclosed box girder 2 effected by the pressure prevailing in the slice chamber 3 of the headbox 50 and exerted upon the lower wall 6 of the enclosed box girder 2.

To compensate the deformation caused by the temperature of the stock or suspension located in the slice chamber 3 the upper portion of the front wall needs to be appropriately heated in order to obtain the same thermal expansion of the material in the upper portion of the front wall as is the case in the lower portion of the front wall in the immediate vicinity of the slice chamber 3. In this respect it could be considered useful to subject the upper elastic tubes 7 underneath the upper wall 5 of the enclosed box girder 2 to the action of a warm medium. In other words, the force exerted by the support elements 7 is generated by a heated pressure or pressurized medium.

The same could be done when heating of the lower portion of the front wall in the region of the lower wall 6 of the enclosed box girder 2 is required.

Figure 5:
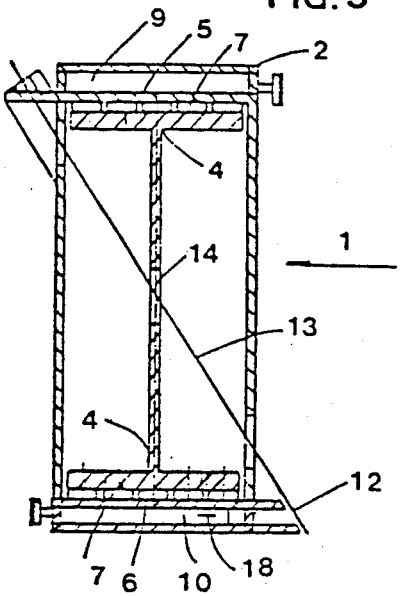
FIG. 5 shows another embodiment of the inventive front wall and support arrangement in cross-section.

It is, however, also possible to attain the required heating action by installing heating elements above the enclosed box girder 2, that is to say, above the upper wall 5 thereof as the embodiment according to FIG. 5 illustrates. Such a heating element or heating means could be constituted by a heating chamber as the same has been generally designated by reference numeral 9 in FIG. 5. This heating chamber 9 extends across the entire length of the enclosed box girder 2. A similar heating measure or facility also could be provided in the lower portion of the enclosed box girder 2, in that there is provided a heating means in the form of a heating chamber 10 located underneath the lower wall 6 of the enclosed box girder 2 and extending substantially parallel to this lower wall 6 across the entire length of the enclosed box girder 2.

In order to ensure sufficient stiffness or rigidity, it is advisable to provide this heating chamber 10 with ribs 18 or equivalent reinforcement structure which serve, on the one hand, to improve the stiffness or rigidity of the profile or cross-sectional area of the corresponding heating chamber and, on the other hand, serve as guide walls or baffles to guide the heating medium through the heating chamber 10. Something similar or equivalent could be provided with respect to the aforementioned upper heating chamber 9. Heating of both sides of the front wall 1 should be effected before starting up the papermaking machine, so that right from the start of the operation of the papermaking machine it will be ensured that the front wall 1 has reached the requisite operating temperature.

It is also imaginable to provide a heatable dome or bonnet or cover 25 for the entire front wall 1 in order to compensate for undesired thermal influences and to bring the entire front wall 1 to the required temperature if so desired or if needed. This heatable dome or cover 25, simply shown in outline in FIG. 3, may or may not be removably attached.

Controlling of the deflection compensation of the front wall 1 is naturally taken care of by a suitable control and regulation arrangement or device 26. This control and regulation arrangement 26 controls the supply and the pressure of the pressurized or pressure medium to the support elements 7, also in the aforementioned zones, as well as the supply of the heating medium to the heating chambers or heating elements 9 and 10. The control and regulation operation is always executed after measuring the deflection of the enclosed box girder 2 by means of any suitable deflection measuring device 27.

For a better understanding of the individual Figures the following explanations are made. The front wall or front wall and support arrangement 1 carries the aforementioned diaphragm or baffle plate which has been generally designated by reference numeral 12, the adjusting or adjustment spindles or the like for the diaphragm or baffle plate 12 have been designated by the reference numeral 13 and the openings provided for the adjusting spindles 13 in the support carrier or beam 4 are designated by reference numeral 14. The front wall 1 is supported by a bolt or shaft 16 on each side thereof which is rotatably mounted or journaled in the structure or framework of the papermaking machine and movable by means of a suitable pivoting mechanism or device 15.

The previously described longitudinal sections or portions of the elastic tubes or hoses constituting the support elements 7 could each have, for example, a length of two meters, can be closed at both of their ends and can each be impinged with the pressurized or pressure medium. These tube or hose sections are disposed in neighboring relation to one another and thus form the aforementioned zones. In this manner it is possible to apply or set a higher pressure in the middle of the enclosed box girder 2, that is to say, in the there located zone, than for example in the lateral zones or end regions.

The heatable dome or cover 25 is intended to heat the entire front wall or front wall and support arrangement 1 to that temperature which the stock in the slice chamber 3 has or will ultimately have. In this manner the deformation of the enclosed box girder 2 caused by the thermal influences can then be effectively prevented.

Figure 7:
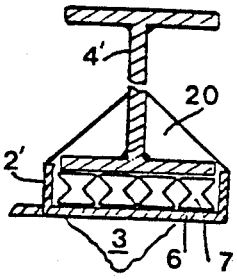
FIG. 7 shows another embodiment of the inventive front wall and support arrangement in cross-sectional view.

FIG. 7 shows a front wall or front wall and support arrangement 1 having a support structure in the form of a stiff U-shaped girder 2' which is supported by a support carrier in the form of a wide flange I-beam 4'. At both ends the I-beam 4' and the U-shaped girder 2' are fixedly attached to one another by means of suitable connections 20.

Figure 8:
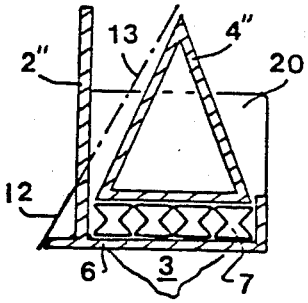
FIG. 8 shows a further embodiment of the inventive front wall in cross-sectional view.

FIG. 8 shows a support structure in the form of a substantially L-shaped girder 2'' which is supported by a support carrier in the form of a beam 4'' possessing a substantially triangular cross-section.

Also possible are thermal actuating support elements, that is to say, support elements featuring heating or cooling elements which either contract or expand in the direction of support.

While there are shown and described present preferred embodiments of the invention, it is to be distinctly understood that the invention is not limited thereto, but may be otherwise variously embodied and practiced within the scope of the following claims.

Accordingly, what we claim is:

1. A front wall and support arrangement at the headbox of a papermaking machine for forming a paper web moving in a predetermined direction of travel, said headbox containing a slice chamber, and said front wall and support arrangement comprising:

a relatively stiff support structure extending substantially across the entire width of the papermaking machine and transverse to the predetermined direction of travel of the paper web;

said relatively stiff support structure having a lower wall;

said relatively stiff support structure being positioned above the slice chamber of the headbox;

said lower wall of said relatively stiff support structure being arranged in confronting relation from above with respect to the slice chamber of the headbox;

a support carrier possessing substantially the same length as said relatively stiff support structure for supporting said relatively stiff support structure and having a first surface;

said lower wall of said relatively stiff support structure and said first surface of said support carrier being arranged in confronting spaced relationship with respect to one another and defining a first intermediate space therebetween; and force-generating support elements comprising expansible support elements filled with a pressurized medium located in and at respective predeterminate portions of said first intermediate spaced and each of said force-generating support elements serving for generating a respective predeterminate force within said respective predeterminate portions of said first intermediate space.

2. The front wall and support arrangement as defined in claim 1, wherein:

said relatively stiff support structure comprises a closed enclosed box girder possessing a substantially upright positioned quadrangular cross-section and further having an upper wall;

said support carrier being positioned within said closed box girder and further having a second surface;

said upper wall of said closed enclosed box girder and said second surface of said support carrier being arranged in confronting spaced relationship with respect to one another and defining a second intermediate space therebetween;

force-generating support elements comprising expansible support elements filled with a pressurized medium located in said second intermediate space and each of said force-generating support elements serving for generating a force within a portion of said second intermediate space; and means for impinging said force-generating expansible support elements in said first and second intermediate spaces with the pressurized medium.

3. The front wall and support arrangement as defined in claim 2, wherein:

said impinging means comprise a respective pressurized medium supply means for the force-generating expansible support elements in said first intermediate space and for the force-generating expansible support elements in said second intermediate space.

4. The front wall and support arrangement as defined in claim 2, wherein:

said impinging means comprise respective pressurized medium supply means for each of the force-generating expansible elements in said first intermediate space and for each of the force-generating expansible support elements in said second intermediate space.

5. The front wall and support arrangement as defined in claim 2, wherein:

said support carrier comprises an upright positioned I-beam.

6. The front wall and support arrangement as defined in claim 1, wherein:

said relatively stiff support structure has a longitudinal axis;

said force-generating expansible support elements comprise elastic tubes having oppositely situated closed ends;

each of said elastic tubes extending substantially parallel to said longitudinal axis of said relatively stiff support structure; and at least one source of pressure cooperating with said force-generating expansible support elements for producing a pressure force in each of said force-generating support elements.

7. The front wall and support arrangement as defined in claim 6, wherein:

said elastic tubes are grouped to define elastic tube segment length zones extending across substantially the entire length of said relatively stiff support structure; and each of said tube segment length zones receiving variable pressures from said at least one source of pressure.

8. The front wall and support arrangement as defined in claim 6, wherein:

said elastic tubes have a bellows-like profile with opposing flat sides and folded sides; and said opposing flat sides serving for contacting both said lower wall of said relatively stiff support structure and said first surface of said support carrier.

9. The front wall and support arrangement as defined in claim 8, wherein:

said force-generating elastic tubes are arranged in a juxtaposed configuration.

10. The front wall and support arrangement as defined in claim 2, further comprising:

heating means for heating an upper portion of said front wall and support arrangement; and said heating means being located along the outside of said upper wall of said enclosed box girder.

11. The front wall and support arrangement as defined in claim 2, further comprising:

a heating chamber for heating a lower portion of said front wall and support arrangement; and said heating chamber being located along and substantially parallel to the outside of said lower wall of said closed box girder and substantially extending across the entire length of said closed box girder.

12. The front wall and support arrangement as defined in claim 2, further including:

means for supplying a heated pressure medium to said force-generating expansible support elements for heating a lower portion of said front wall and support arrangement.

13. The front wall and support arrangement as defined in claim 1, further including:

means for supplying a heated pressure medium to said force-generating expansible support elements for heating predeterminate portions of a lower portion of said front wall and support arrangement.

14. The front wall and support arrangement as defined in claim 1, further comprising:

a heatable dome for heating said front wall and support arrangement.

15. The front wall and support arrangement as defined in claim 10, further including:

a deflection measuring device for measuring deflections of said closed box girder; and a control and regulation arrangement for supplying said pressurized medium to said force-generating expansible support elements and for energizing said heating means in dependence upon the operation of said deflection measuring device.

16. A front wall and support arrangement at the headbox of a papermaking machine for forming a paper web moving in a predetermined direction of travel, said headbox containing a slice chamber, and said front wall and support arrangement comprising:

a relatively stiff support structure extending substantially across the entire width of the papermaking machine and transverse to the predetermined direction of travel of the paper web;

said relatively stiff support structure having a first wall and a second wall;

said relatively stiff support structure being positioned above the slice chamber of the headbox;

a support carrier possessing substantially the same length as said relatively stiff support structure for supporting said relatively stiff support structure and having a first surface and a second surface;

said support carrier being arranged within said relatively stiff support structure;

said first wall of said relatively stiff support structure and said first surface of said support carrier being arranged in confronting spaced relationship with respect to one another and defining a first intermediate space therebetween;

said second wall of said relatively stiff support structure and said second surface of said support carrier being arranged in confronting spaced relationship with respect to one another and defining a second intermediate space therebetween;

force-generating support elements comprising expansible support elements filled with a pressurized medium located in and at respective predeterminate portions of each of said first intermediate space and said second intermediate space; and each of said force-generating expansible support elements serving for generating a respective predeterminate force within said respective predeterminate portions of said first intermediate space and said second intermediate space in order to be able to selectively compensate for concave and convex deflections of said relatively stiff support structure.

17. A front wall and support arrangement at the headbox of a papermaking machine for forming a paper web moving in a predetermined direction of travel, said headbox containing a slice chamber having a lengthwise direction and a transverse direction, and said front wall and support arrangement comprising:

a relatively stiff support structure extending substantially across the entire width of the papermaking machine and transverse to the predetermined direction of travel of the paper web;

said relatively stiff support structure having a lower wall;

said relatively stiff support structure being positioned above the slice chamber of the headbox;

said lower wall of said relatively stiff support structure being arranged in confronting relation from above with respect to the slice chamber of the headbox;

a support carrier possessing substantially the same length as said relatively stiff support structure for supporting said relatively stiff support structure and having a first surface;

said lower wall of said relatively stiff support structure and said first surface of said support carrier being arranged in confronting spaced relationship with respect to one another and defining a first intermediate space therebetween;

force-generating support elements comprising expansible support elements filled with a pressurized medium respectively located in and at predetermined portions of said first intermediate space;

each of said force-generating expansible support elements serving for generating a respective predeterminate force within said predeterminate portions of said first intermediate space both in the lengthwise direction and in the transverse direction of said slice chamber.

18. The front wall and support arrangement as defined in claim 17, wherein:

said relatively stiff support structure has a predeterminate height; and said support carrier being disposed within said relatively stiff support structure and extending substantially co-extensive with respect to said predeterminate height of said relatively stiff support structure.

19. The front wall and support arrangement as defined in claim 17, wherein:

said support carrier possesses a second surface;

said relatively stiff support structure having an upper wall positioned in spaced confronting relationship with respect to said second surface to define therebetween a second intermediate space;

force-generating support elements comprising expansible support elements filled with a pressurized medium located in and at respective predeterminate portions of said second intermediate space;

each of said force-generating expansible support elements located in and at said respective predeterminate portions of said second intermediate spaced serving for generating a respective predeterminate force within said respective predeterminate portions of said second intermediate space; and said force-generating expansible support elements within said first intermediate space and said force-generating expansible support elements within said second intermediate space selectively serving for compensating convex and concave deflections of said relatively stiff support structure.

* * * * *

UNITED STATES PATENT AND TRADEMARK OFFICE

CERTIFICATE OF CORRECTION

PATENT NO. : 4,770,745

DATED : September 13, 1988

INVENTOR(S) : OTTO HILDEBRAND et al

It is certified that error appears in the above-identified patent and that said Letters Patent is hereby corrected as shown below:

Column 8, line 36, after "expansible" please insert --support--

Column 9, line 29, please delete "said" and insert --a--

Column 11, line 8, after "force-generating" please insert --expansible--

Column 12, line 3, please delete "spaced" and insert --space--

Signed and Sealed this

Seventh Day of March, 1989

*Attest:*

DONALD J. QUIGG

*Attesting Officer*

*Commissioner of Patents and Trademarks*